US011304015B2

(12) United States Patent
Haagerup et al.

(10) Patent No.: US 11,304,015 B2
(45) Date of Patent: Apr. 12, 2022

(54) CONCEPT FOR ATTACHING A SOUND PROCESSOR TO THE HEAD VIA AN INTERCHANGEABLE MAGNET

(71) Applicant: Oticon Medical A/S, Smørum (DK)

(72) Inventors: Emilie Munk Haagerup, Smørum (DK); Claus Tipsmark, Smørum (DK); Johan Rosengren, Smørum (DK); Rasmus Lund, Smørum (DK); Glenn Jensen, Smørum (DK); Bent Jakobsen, Smørum (DK)

(73) Assignee: Oticon Medical A/S, Smørum (DK)

( * ) Notice: Subject to any disclaimer, the term of this patent is extended or adjusted under 35 U.S.C. 154(b) by 0 days.

(21) Appl. No.: 16/950,237

(22) Filed: Nov. 17, 2020

(65) Prior Publication Data

US 2021/0152954 A1 May 20, 2021

(30) Foreign Application Priority Data

Nov. 18, 2019 (EP) ..... 19209787

(51) Int. Cl.
*H04R 25/00* (2006.01)

(52) U.S. Cl.
CPC ..... *H04R 25/604* (2013.01); *H04R 25/65* (2013.01)

(58) Field of Classification Search
CPC .... H04R 25/604; H04R 25/554; H04R 25/65; H04R 25/602; H04R 2225/61; H04R 2225/67
See application file for complete search history.

(56) References Cited

U.S. PATENT DOCUMENTS

2017/0347208 A1* 11/2017 Jurkiewicz ..... H04R 25/554

FOREIGN PATENT DOCUMENTS

| | | | |
|---|---|---|---|
| EP | 3 404 933 | A1 | 11/2018 |
| WO | WO 2010/056768 | A1 | 5/2010 |
| WO | WO 2017/203485 | A1 | 11/2017 |
| WO | WO 2019/083540 | A1 | 5/2019 |

* cited by examiner

*Primary Examiner* — Amir H Etesam

(74) *Attorney, Agent, or Firm* — Birch, Stewart, Kolasch & Birch, LLP

(57) ABSTRACT

A hearing aid for placement on the head. The hearing aid includes a first part comprising an acoustic input transducer adapted to convert an ambient sound picked up at an ear of the user to an electric signal, a signal processor adapted to process the electric signal according to specifications of the user into a processed electric signal, and an output transducer adapted to convert the processed electric signal into a transmission signal, and a second part linkable to said first part by magnetic forces and comprising a receiver adapted to receive the transmission signal and convert the transmission signal to an output signal perceivable as sound by the user. Said first part comprises a receptacle adapted to receive an insert element, said insert element comprising protrusions configured for engaging with a recess of said first part by rotating the insert element relative to said first part.

19 Claims, 6 Drawing Sheets

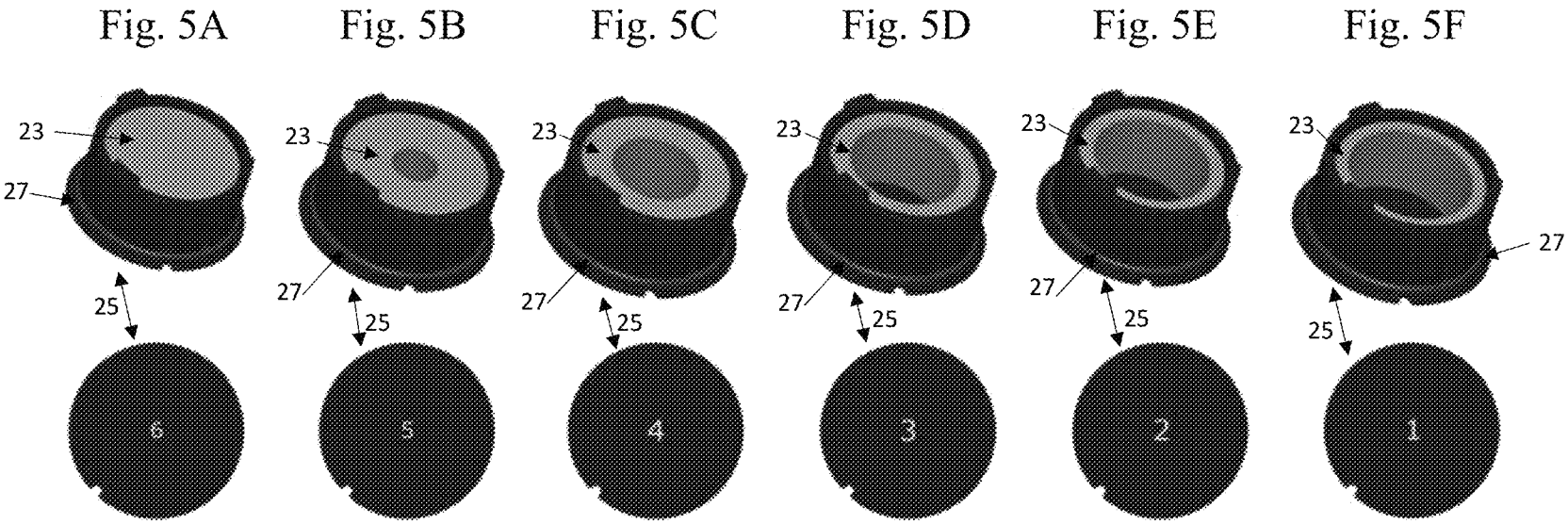
Fig. 5A
Fig. 5B
Fig. 5C
Fig. 5D
Fig. 5E
Fig. 5F
23
27
25
6
5
4
3
2
1
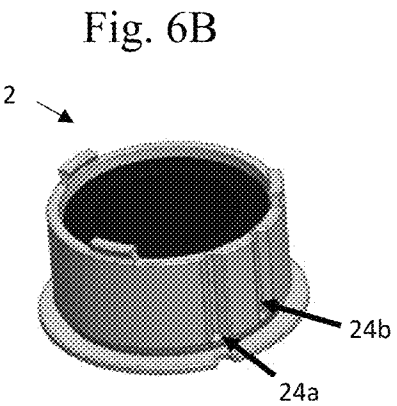
Fig. 6B
2
24a
24b
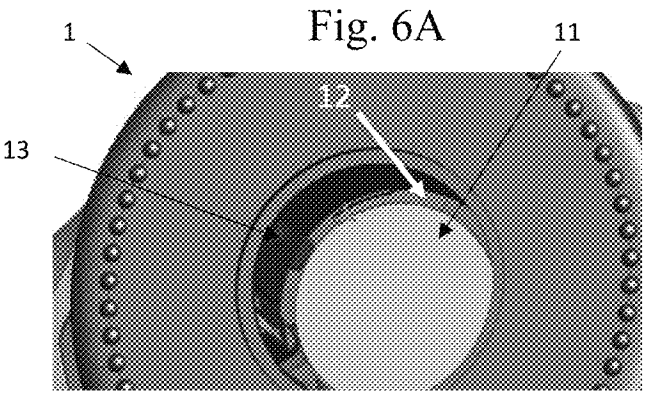
Fig. 6A
1
11
12
13

CONCEPT FOR ATTACHING A SOUND PROCESSOR TO THE HEAD VIA AN INTERCHANGEABLE MAGNET

FIELD

The present disclosure relates to sound processors for hearing devices configured to be attached to the head of a user. More particularly, the disclosure relates to a concept for attaching a sound processor to the head of a user via an interchangeable magnet.

BACKGROUND

To attach a sound processor of a hearing aid on the head of a user via a magnet solution, it is required to provide different magnet strengths. Patients using the hearing device may have different skin thicknesses. Therefore, the required magnet strength for attaching a sound processor on the head of the patient is a trade-off between keeping the sound processor on the head and keeping the patient safe. Using too strong magnet strength might influence the blood flow or injure the patients.

Therefore, there is a need to provide a solution that allows for preventing patients to get injured by a magnet strength while keeping the sound processor safely attached to the head of a user.

Furthermore, when using a hearing aid (e.g., when changing a battery of a hearing aid), a locking mechanism is used several times and thereby becomes worn, which results in a noticeable play in the locking mechanism. Locking the battery lid with a magnet may prevent the play in the battery system. The battery lid may be closed always without any play.

SUMMARY

According to an aspect, a hearing aid for placement on the head of a user is provided. The hearing aid comprises a first part comprising an acoustic input transducer adapted to convert an ambient sound picked up at an ear of the user to an electric signal, a signal processor adapted to process the electric signal according to specifications of the user into a processed electric signal, and an output transducer adapted to convert the processed electric signal into a transmission signal. Furthermore, the hearing aid comprises a second part linkable to said first part by magnetic forces and comprising a receiver adapted to receive the transmission signal and convert the transmission signal to an output signal perceivable as sound by the user. The first part further comprises a receptacle adapted to receive an insert element. The insert element comprises at least one protrusion configured for engaging with a recess of said first part by rotating the insert element relative to said first part.

The first part of the hearing aid comprises a receptacle adapted to receive an insert element, wherein the insert element comprises at least one protrusion configured for engaging with a recess of said first part by rotating the insert element relative to said first part. By rotating the insert element relative to the first part of the hearing aid, the insert element is secured by the engaging of its protrusion(s) with the recess(es) of the first element.

According to another aspect, said output transducer comprises a transmission coil configured to inductively transmit said transmission signal to a reception coil in said receiver of said second part, and said receptacle is arranged in said first part such that said transmission coil surrounds said insert element.

According to yet another aspect, the insert element has a cylindrical shape, and the receptacle of the first part has a cylindrical shape corresponding to the cylindrical shape of the insert element.

By ensuring that the shape of the insert element corresponds to the shape of the first part it is secured that the insert element perfectly matches in the receptacle of the first part.

According to another aspect, the insert element comprises a plate on a first axial end surface extending in a radial direction beyond the cylindrical surface of the insert element, wherein the plate is configured to be flush with a head contacting surface of the first part.

According to yet another aspect, the insert element and the first part comprises protrusions and recesses to form a bayonet connection.

According to another aspect, the at least one protrusion of the insert element is provided on a second axial end surface of the insert element protruding away from the insert element in an axial direction and forming a bayonet claw.

According to yet another aspect, more than one protrusion is provided on the insert element and the protrusions are equally spaced apart from each other in a circular direction.

According to another aspect, the insert element and the first part are connectable by means of a male/female thread to be screwed together.

According to yet another aspect, the connection between the insert element and the first part comprises at least one groove extending in an axial direction along the peripheral surface of the insert element or the first part. The first part or the insert element comprises at least one resilient rib arranged on the outer peripheral surface and the at least one resilient rib is configured to engage with the at least one groove when the insert element is positioned in the receptacle of the first part, wherein the resilient rib is adapted to be pushed out from the groove when rotating the insert element. The resilient rib may be adapted to be pushed out from the groove when rotating the insert element to a second position which is different from a first position where the resilient rib is arranged within the groove.

According to another aspect, the rotation of the insert element is locked by inserting the resilient rib into one of the at least one grooves.

According to yet another aspect, the insert element is introduced into the receptacle from the head side of the first part.

According to another aspect, the insert element is a magnet module consisting of a magnet holder preferably made of plastic, a seal ring and a magnet.

By using an insert element as a magnet module, the magnet module becomes an interchangeable part. By the use of a seal ring, it is ensured that no dirt enters from the skin side of the hearing aid into the magnet module.

According to yet another aspect, the magnet is column shaped.

According to another aspect, an outer shape of the magnet is equal to an inner shape of the magnet holder and wherein the magnet is glued into the magnet holder.

By using an outer shape of the magnet, which is equal to an inner shape of the magnet holder the magnet is guided in the hearing aid. Moreover, by gluing the magnet into the magnet holder, the magnet is also secured in the hearing aid.

According to yet another aspect, the magnet is solid or has an inner hole extending in the axial direction of the column shape, wherein the diameter of the hole is selected, so as to set the overall magnet strength.

Varying the diameter of the hole of the magnet allows for varying the overall magnetic strength of the insert element, and thereby ensuring the safety of the user of a hearing aid.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIGS. 5A to 5F illustrate example implementations of the insert element with different magnets varying in diameter;

FIG. 6A illustrates a view into the receptacle of the first part of the hearing aid according to the embodiment;

FIG. 6B is a perspective view on the insert element according to the embodiment;

DETAILED DESCRIPTION

Figure 1A:
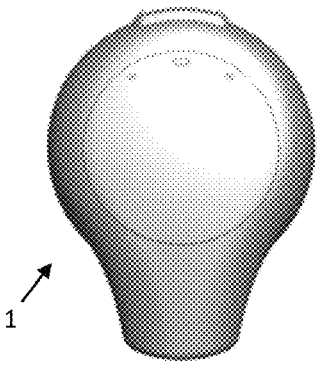
FIG. 1A is a top view on a first part of a hearing aid according to an embodiment of the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Now referring to FIG. 1A, which illustrates, in top view, a first part 1 of a hearing aid according to an aspect of the disclosure. The shown shape of the first part 1 of the hearing aid is an example only, and other shapes may be possible. In the embodiment, the first part 1 has the form of a flattened drop having a round bodied upper part and a thinner, tapering lower part. Both parts are seamlessly integrated with each other. Moreover, in the middle of the round bodied upper part a top cover is provided, covering e.g., the circuitry of the first part. In addition, the top cover is configured to be flush with the remaining body of the upper part of the first part 1. The first part 1, which is for example a sound processor, of the hearing aid is attached to the head of a user of the hearing aid. The first part comprises an acoustic input transducer (not shown), which converts a sound into an electric signal. The sound is picked up at an ear of the user. Furthermore, the first part 1 comprises a signal processor (not shown), which processes the electric signal according to specifications of the user into a processed signal. Moreover, the first part 1 comprises an output transducer (not shown), which converts the processed electric signal into a transmission signal. The transmission signal is then transmitted to a second part (not shown) of the hearing aid. The second part (e.g., an internal processor of the hearing aid and the like) is implanted into the head of a user, wherein the second part comprises a receiver receiving the transmission signal from the first part 1 of the hearing aid. Furthermore, the second part converts the received transmission signal to an output signal, which is perceivable as sound by the user.

The output transducer of the first part 1 comprises a transmission coil, which is configured to inductively transmit the transmission signal to a reception coil in the receiver of the second part.

Figure 1B:
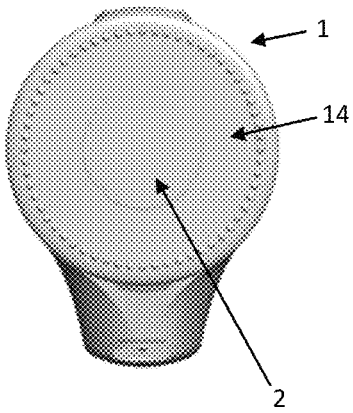
FIG. 1B is a bottom view on the first part of the hearing aid with a mounted insert element according to the embodiment.
Figure 1C:
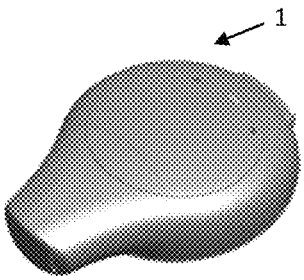
FIG. 1C is a perspective view on the first part of the hearing aid according to the embodiment.

FIG. 1B illustrates a bottom view of the first part 1 of the hearing aid according to the embodiment, wherein an insert element 2 is mounted into a receptacle 11 (e.g., an available space) of the first part 1. The receptacle 11 is arranged in the first part 1 of the hearing aid such that the transmission coil of the first part surrounds the insert element 2. The illustrated surface of the first part 1 faces the head (skin) of the user. In other words, the insert element 2 is introduced into the receptacle 11 from the head side of the first part 1. FIG. 1C is a perspective view on the first part 1 of the hearing aid according to the embodiment.

Figure 2:
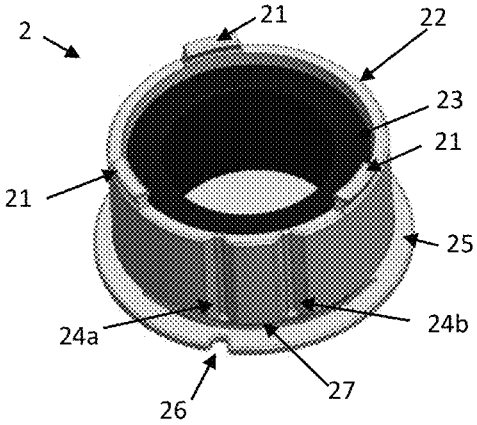
FIG. 2 is a perspective view on the insert element comprising a magnet with a first size according to the embodiment.

FIG. 2 illustrates a perspective view on the insert element 2 according to the embodiment. The insert element 2 has a cylindrical shape and comprises three protrusions 21 (in the following commonly referred to as protrusion 21). Each protrusion 21 is configured for engaging with a recess 12 (illustrated in FIG. 6A) of the first part 1 of the hearing aid by rotating the insert element 2 relative to the first part 1. Furthermore, the protrusion 21 is provided on a (upper) axial end surface of the insert element 2 and protrudes away from the insert element 2 in an axial direction. In addition, one or plural protrusions 21 may be provided on the insert element 2, wherein the protrusions 21 may be equally spaced apart from each other in a circular direction. Furthermore, each protrusion 21 may form a bayonet claw. In an embodiment, the insert element 2 is a magnet module consisting of a magnet holder 22, which is preferably made of plastic, a seal ring 27 (e.g., an O-ring) and a magnet 23. The seal ring 27 suppresses dirt from entering on the skin side of the first part 1. The outer shape of the magnet 23 is equal to an inner shape of the magnet holder 22. Furthermore, the magnet 23 is glued into the magnet holder 22. The use of an inner shape of the magnet holder 22, which is equal to an outer shape of the magnet 23, allows to guide and secure the magnet 23 in the magnet holder 22. In addition, gluing the magnet 23 into the magnet holder 22 may even enhance the security. Moreover, the insert element 2 of the embodiment comprises two grooves 24*a*, 24*b* extending in an axial direction along the peripheral surface of the insert element 2. Furthermore, the insert element 2 comprises a plate 25 on another (lower) axial end surface. The plate 25 extends in a radial direction beyond the cylindrical surface of the insert element 2. The plate 25 is thereby configured to be flush with a head contacting surface 14 of the first part 1 of the hearing aid. Together with the cylindrical wall and the plate 25, the cup-shape of the insert element 2 is defined. Moreover, the plate 25 has a notch 26 on its outer edge. The notch may allow for use of a service tool 3 to lock the insert element 2 into the receptacle 11.

Figure 3A:
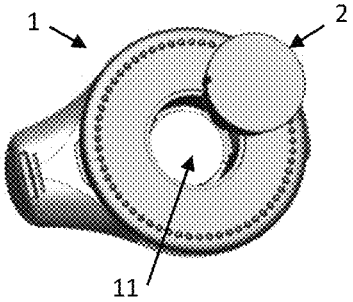
FIG. 3A illustrates a bottom view of the first part of the hearing aid with a receptacle and the non-inserted insert element according to the embodiment.
Figure 3B:
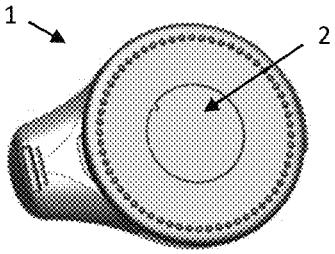
FIG. 3B illustrates a bottom view of the first part of the hearing aid with inserted insert element according to the embodiment, wherein the insert element is unlocked.

FIG. 3A illustrates a bottom view of the first part 1 of the hearing aid with the receptacle 11 and the non-inserted insert element 2 according to the embodiment. The insert element 2 is inserted into the receptacle 11 from the head side of the first part 1. After the insertion, the insert element 2 firstly remains unlocked in the first part 1 of the hearing aid (FIG. 3B). In this position, the groove 24*a* is engaged with a rib 13, which will be described with respect to FIG. 6A.

Figure 3C:
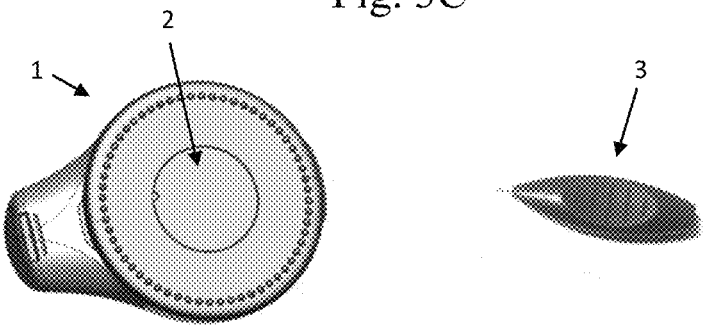
FIG. 3C illustrates a bottom view of the first part of the hearing aid with inserted insert element according to the embodiment, wherein the insert element is locked to the first part by means of a service tool.

Then, by the use of the service tool 3, the insert element 2 is rotated (e.g., by inserting the service tool 3 into the notch) and thereby fixed into the first part 1 of the hearing aid (FIG. 3C). After rotating, the other groove 24*b* is engaged with the rib 13.

Figure 4A:
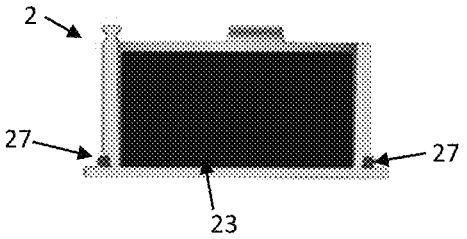
FIGS. 4A to 4F illustrate cross sectional views of insert elements with different magnet sizes.
Figure 4B:
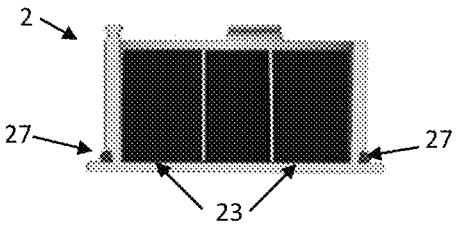
Figure 4C:
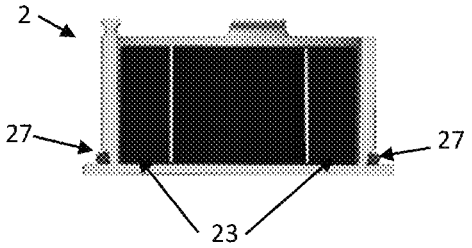
Figure 4D:
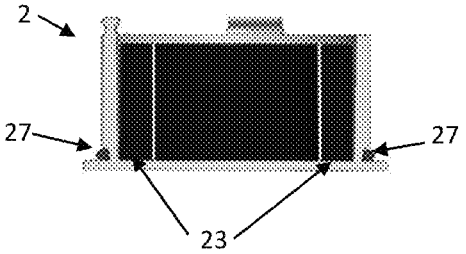
Figure 4E:
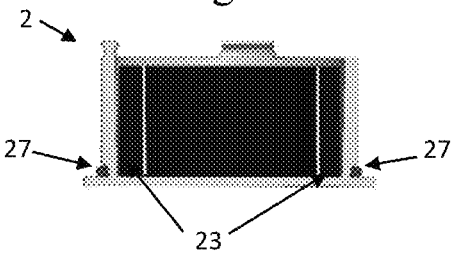
Figure 4F:
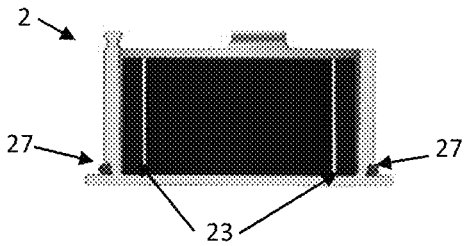

In order to vary the overall magnetic strength of the insert element 2, the shape of the magnet 23 assembled in the magnet holder 22 may be changed. According to the embodiment the magnets 23 are designed as rings, except for the strongest (largest) magnet, which is a disc filling the complete space of the receptacle 11 of the magnet holder 22 (solid magnet), to provide the largest possible magnetic strength. The larger an inner diameter of the ring (e.g., the hole in the magnet), the smaller the remaining magnetic strength. In FIGS. 4A to 4F cross sectional views of six example insert elements 2 with different magnet sizes are illustrated, wherein FIG. 4A shows a solid magnet (the magnet with the largest magnetic strength). In the order from FIG. 4A to FIG. 4F, the overall magnetic strength is decreasing, as the inner diameter of the ring is increasing. In this embodiment each magnet 23 may be column shaped.

However, it is possible to choose other magnet sizes, wherein the solid magnet remains the magnet with the largest possible magnetic strength. Other possible magnet sizes can be acquired by adapting the inner diameter of the magnet 23, wherein the inner diameter does not interfere with anything in the assembly and thereby the assembly process of such a new magnet remains the same.

FIGS. 5A to 5F illustrate example implementations of the insert element 2 with different magnets 23 varying in inner diameter, wherein the strength of the magnet is decreasing with the growth of the inner diameter. FIGS. 5A to 5F illustrate another view of the example insert elements 2 of FIGS. 4A to 4F.

FIG. 6A illustrates a view into the receptacle 11 of the first part 1 of the hearing aid according to the embodiment. The first part 1 of the hearing aid comprises the receptacle 11, wherein the receptacle 11 has a cylindrical shape corresponding to the cylindrical shape of the insert element 2. This allows an easy inserting of the insert element 2 into the receptacle 11 of the first part 1 and ensures a flush resulting surface. Further, the shape and size of the receptacle 11 substantially correspond to that of the transmission coil of the first part 1.

FIG. 6B is a perspective view on the insert element 2 according to the embodiment. In the following, an example assembly of the insert element 2 into the first part 1 is described.

According to the embodiment, the insert element 2 slides into the first part 1 using a resilient rib 13 (e.g., click feature) inside the first part 1 as a guide. In other words, the insert element 2 is inserted into the receptacle 11 while the groove 24*a* engages with the resilient rib 13. The insert element 2 is inserted until the plate 25 comes to rest on the edge of the receptacle 11, i.e., so as to be flush with the head contacting surface 14 of the first part 1. By rotating the insert element 2 relative to the first part 1, the recess 12 of the first part 1 engages with the protrusion 21, thereby forming a bayonet connection. When the bayonet connection is established, the resilient rib 13 again assumes its initial position by entering the second groove 24*b*. In order for allow for the rotation of the insert element 2 relative to the first part 1, the rib 13 is resilient, i.e., it is arranged so that it can retreat in radial direction. The rotation of the insert element 1 is thus locked by inserting (pushing out) the resilient rib 13 into the other groove 24*b*.

Since the rotation requires a certain torque for pushing the resilient rib 13 out of the way, the service tool 3 of FIG. 3C may be used to ease the rotation of the insert element 2. When designing groove 24*b* with sidewalls extending in radial direction, one can provide the insert element 2 with an irreversible locking of the rotation position of the insert element 2. With the groove 24*b* as shown in FIG. 6B the side walls of the grooves 24*a*, 24*b* are inclined, which allows for releasable locking.

Alternatively, the insert element 2 and the first part 1 may also be connected by means of a male/female thread to be screwed together. In this case, also the locking function may be used.

In an inverted arrangement, the connection between the insert element 2 and the first part 1 may comprise at least one groove extending in an axial direction along the peripheral surface of the insert element 2 or the first part 1. The first part 1 or the insert element 2 may comprise at least one resilient rib 13 arranged on the outer peripheral surface. Furthermore, the at least one resilient rib 13 is configured to engage with the at least one groove 24*a*, 24*b* when the insert element 2 is positioned in the receptacle 11 of the first part 1. Moreover, the resilient rib 13 is adapted to be pushed out from the groove 24*a*, 24*b* when rotating the insert element 1 towards its final position. In other words, the insert element 1 and/or the first part 1 may have complementary resilient ribs, grooves, protrusions and/or recesses. In summary, the same functions as described above can be obtained by this inverse arrangement.

With regard to the battery change, the present embodiment comprises a magnetic fixing of a battery lid, closing a battery compartment. For this the hearing aid comprising the first part 1 (e.g., a sound processor) with or without the receptacle 11 may be used. The sound processor 1 has a battery receptacle 9 and a battery lid 4 for closing the receptacle, wherein at least one of the sound processor 1 or the battery lid 4 is provided with at least one magnet 5, 6 to fix the battery lid 4 in the closed position.

The sound processor 1 has a recess for receiving a magnet therein, which recess is closed to the outside by a magnet cap 7.

Furthermore, the battery lid 4 is attractable by magnetic forces and adapted to slide over the battery receptacle 9 and being held in the closed position by forces of said magnet in the sound processor 1.

In addition, the battery lid 4 has a recess for receiving a magnet plate 6 arranged to be opposite said magnet 5, when the lid 4 is in closed position.

The magnet 5, 6 can be positioned in either of the battery lid 4 and the sound processor 1, while the other part has a magnetically attractable portion.

Figure 7:
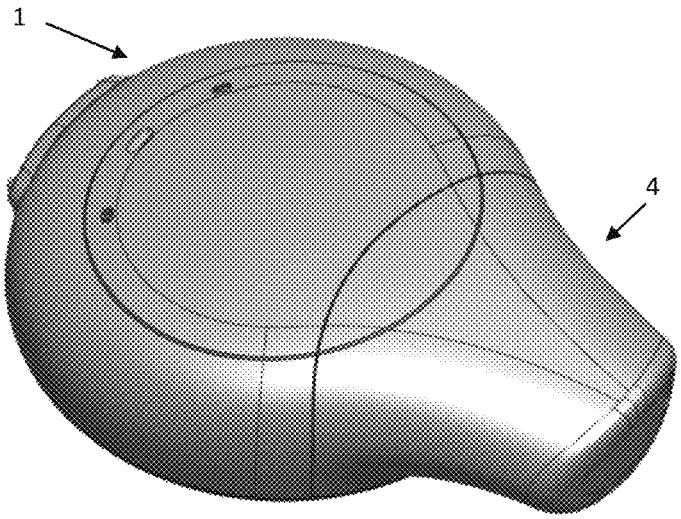
FIG. 7 illustrates a first part of a hearing aid with closed battery lid according to another embodiment of the disclosure.
Figure 8:
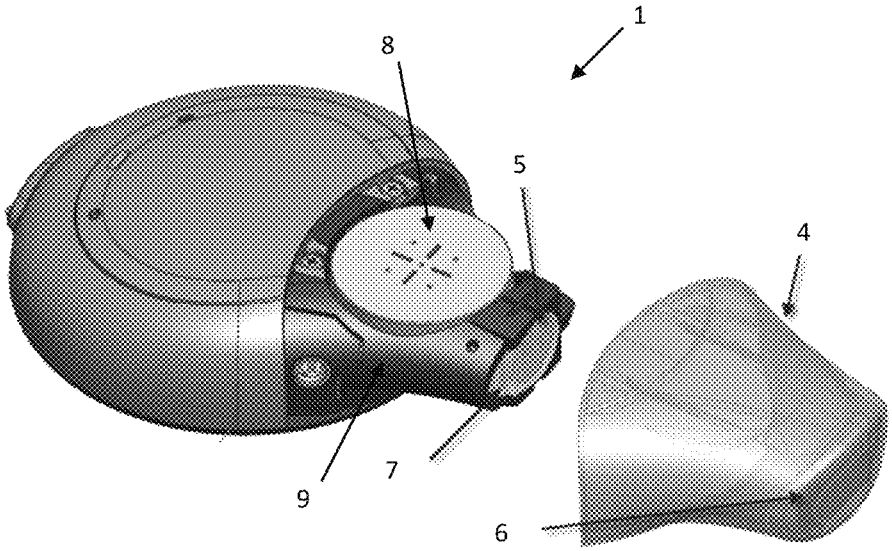
FIG. 8 illustrates the first part of the hearing aid with opened battery lid and the battery lid according to the other embodiment.

FIG. 7 illustrates a first part 1 of a hearing aid with closed battery lid 4 according to another embodiment of the disclosure. In FIG. 8, the first part 1 of the hearing aid is illustrated with opened battery lid 4. The battery lid 4 is designed such that it forms a smooth surface with the remainder of the first part 1. The first part 1 comprises the battery receptacle 9, which has a curved shape and converges closer to the radially outer end. In the front of the battery receptacle a recess is provided, configured to receive a magnet 5 or a magnetically attractable portion (e.g., a metal sheet). The middle axis of the recess extends substantially perpendicular to the main axis of the battery compartment. The recess including the magnet 5 may be closed by a magnet cap 7 of non-magnetic material, e.g., plastic. The battery lid 4 may also comprise a magnet plate 6, which is attractable by magnet 5. The magnet plate 6 can be a magnet itself or is of a ferromagnetic material.

If the first part 1 does not comprise a magnet 5, only the battery lid 4 may comprise a magnet plate 6. However, it is also possible, that both the first part 1 and the battery lid 4 each comprise a magnet. Moreover, in another embodiment, the battery lid 4 comprises a magnetically attractable portion and the first part 1 comprises the magnet 5.

Figure 9:
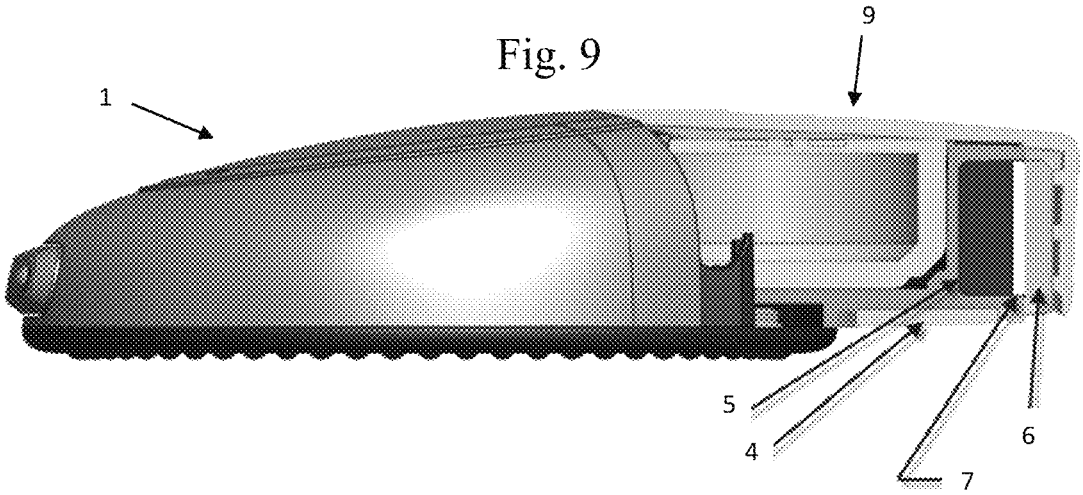
FIG. 9 illustrated the first part of the hearing aid with a cross-sectional view in the battery lid area.

FIG. 9 illustrates the first part 1 of the hearing aid with a cross-sectional view in the battery lid area. The battery lid 4 is attracted by magnetic forces and slides over the battery receptacle 9 to close it. When closing the battery receptacle 9 the magnet plate 6 is positioned opposite to the magnet 5 of the first part 1, wherein the magnet cap 7 is positioned between them. The battery lid 4 is held in the closed position by magnetic forces of the magnet 5 in the first part 1.

Figure 10:
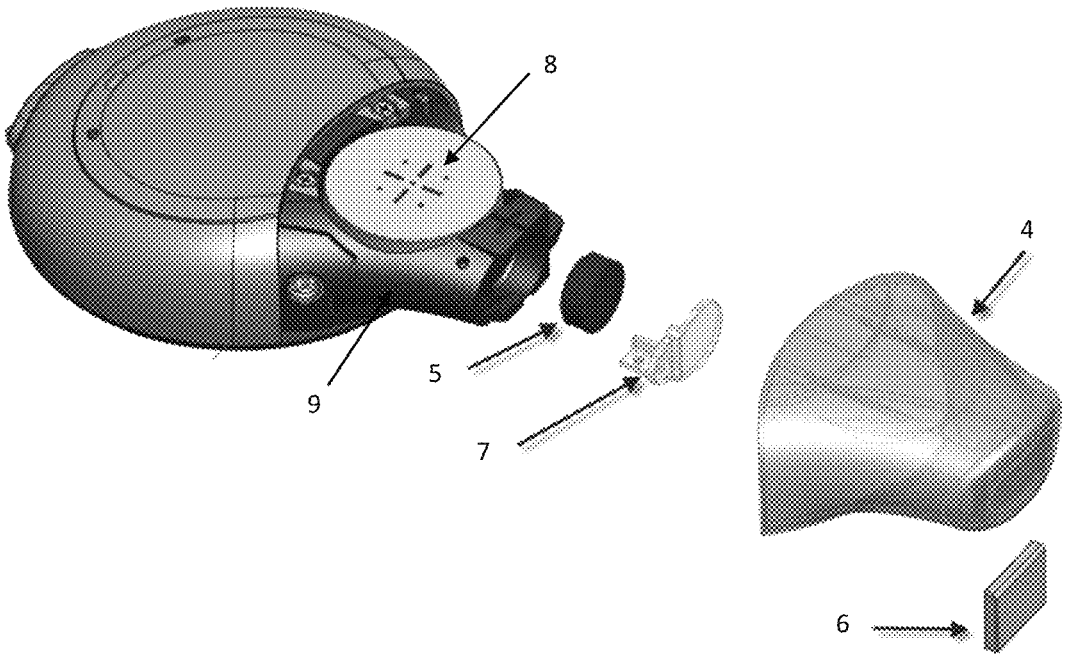
FIG. 10 illustrates the first part of the hearing aid with the battery lid in exploded view.

FIG. 10 illustrates the first part 1 of the hearing aid with the battery lid 4 in exploded view showing the order of appearance of the elements of the magnet 5, the magnet cap 7 and the magnet plate 6 with the battery lid 4.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid for placement on the head of a user comprising:

a first part comprising:

an acoustic input transducer adapted to convert an ambient sound picked up at an ear of the user to an electric signal, a signal processor adapted to process the electric signal according to specifications of the user into a processed electric signal, and an output transducer adapted to convert the processed electric signal into a transmission signal and transmit the transmission signal inductively, and a second part linkable to said first part by magnetic forces, and where the second part is configured to be implanted into the head of the user, and the second part comprising:

a receiver adapted to receive the transmission signal inductively and convert the transmission signal to an output signal perceivable as sound by the user, wherein said first part further comprises a receptacle adapted to receive an insert element, and where the receptacle is arranged in said first part such that said transmission coil surrounds said insert element, said insert element comprising at least one protrusion configured for engaging with a corresponding recess of said first part by rotating the insert element relative to said first part, and said insert element is a magnet module consisting of a magnet holder, a seal ring and/or a magnet, wherein the insert element has a substantially cylindrical component, wherein the at least one protrusion is located on an axial end surface of the substantially cylindrical component, and protrudes away from the substantially cylindrical component in an axial direction, and wherein the insert element and the first part are connectable by means of a male/female thread to be screwed together.

2. The hearing aid according to claim 1, wherein said output transducer comprises a transmission coil configured to inductively transmit said transmission signal to a reception coil in said receiver of said second part, and said receptacle is arranged in said first part such that said transmission coil surrounds said insert element.

3. The hearing aid according to claim 1, wherein the insert element has a cylindrical shape, and wherein the receptacle of the first part has a cylindrical shape corresponding to the cylindrical shape of the insert element.

4. The hearing aid according to claim 3, wherein the insert element comprises a plate on a first axial end surface extending in a radial direction beyond the cylindrical surface of the insert element, wherein the plate is configured to be flush with a head contacting surface of the first part.

5. The hearing aid according to claim 1, wherein the insert element comprises recesses and the first part comprises a protrusion, and wherein the recesses and protrusions of the insert element and the first part are configured to form a bayonet connection.

6. The hearing aid according to claim 1, wherein the at least one protrusion of the insert element is provided on a second axial end surface of the insert element in such manner as to form a bayonet claw.

7. The hearing aid according to claim 6, wherein more than one protrusion is provided on the insert element and the protrusions are equally spaced apart from each other in a circular direction.

8. A hearing aid for placement on the head of a user comprising:

a first part comprising:

an acoustic input transducer adapted to convert an ambient sound picked up at an ear of the user to an electric signal, a signal processor adapted to process the electric signal according to specifications of the user into a processed electric signal, and an output transducer adapted to convert the processed electric signal into a transmission signal and transmit the transmission signal inductively, and a second part linkable to said first part by magnetic forces, and where the second part is configured to be implanted into the head of the user, and the second part comprising:

a receiver adapted to receive the transmission signal inductively and convert the transmission signal to an output signal perceivable as sound by the user, wherein said first part further comprises a receptacle adapted to receive an insert element, and where the receptacle is arranged in said first part such that said transmission coil surrounds said insert element, said insert element comprising at least one protrusion configured for engaging with a corresponding recess of said first part by rotating the insert element relative to said first part, and said insert element is a magnet module consisting of a magnet holder made of plastic, a seal ring and/or a magnet, and wherein the connection between the insert element and the first part comprises at least one groove extending in an axial direction along a peripheral surface of the insert element or the first part and wherein the first part or the insert element comprises at least one resilient rib arranged on an outer peripheral surface and wherein the at least one resilient rib is configured to engage with the at least one groove when the insert element is positioned in the receptacle of the first part, wherein the resilient rib is adapted to be pushed out from the at least one groove (when rotating the insert element.

9. The hearing aid according to claim 8, wherein the rotation of the insert element is locked by inserting the resilient rib into at least one grooves.

10. The hearing aid according to claim 1, where the first part includes a head side which is directed towards the skin of the user when in use, and wherein the insert element is introduced into the receptacle from the head side of the first part.

11. The hearing aid according to claim 1, wherein the insert element is a magnet module consisting of a magnet holder, a seal ring and a magnet.

12. The hearing aid according to claim 11, wherein the magnet is column shaped.

13. The hearing aid according to claim 11, wherein an outer shape of the magnet is equal to an inner shape of the magnet holder and wherein the magnet is glued into the magnet holder.

14. The hearing aid according to claim 11, wherein the magnet is solid or has an inner hole extending in the axial direction of the column shape, wherein the diameter of the hole is selected, so as to set an overall magnet strength.

15. The hearing aid according to claim 2, wherein the insert element has a cylindrical shape, and wherein the receptacle of the first part has a cylindrical shape corresponding to the cylindrical shape of the insert element.

16. The hearing aid according to claim 2, wherein the insert element comprises recesses and the first part comprises a protrusion, and wherein the recesses and protrusions of the insert element and the first part are configured to form a bayonet connection.

17. The hearing aid according to claim 3, wherein the insert element comprises recesses and the first part comprises a protrusion, and wherein the recesses and protrusions of the insert element and the first part are configured to form a bayonet connection.

18. The hearing aid according to claim 4, wherein the insert element comprises recesses and the first part comprises a protrusion, and wherein the recesses and protrusions of the insert element and the first part are configured to form a bayonet connection.

19. The hearing aid according to claim 2, wherein the at least one protrusion of the insert element is provided on a second axial end surface of the insert element protruding away from the insert element in an axial direction and forming a bayonet claw.

* * * * *